US007839281B2

(12) United States Patent
Manahan

(10) Patent No.: US 7,839,281 B2
(45) Date of Patent: Nov. 23, 2010

(54) EXPLOSION INDICATOR FOR EXPLOSION-PROOF ENCLOSURES

(75) Inventor: Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 284 days.

(21) Appl. No.: 12/123,063

(22) Filed: May 19, 2008

(65) Prior Publication Data

US 2009/0284381 A1 Nov. 19, 2009

(51) Int. Cl.
*G08B 21/00* (2006.01)

(52) U.S. Cl. ..... 340/540; 340/691.1; 340/287

(58) Field of Classification Search ..... 340/540, 340/691.1, 693.5, 693.9, 287, 286.05, 286.11, 340/289, 300, 815.4, 815.55
See application file for complete search history.

(56) References Cited

U.S. PATENT DOCUMENTS

| | | | | | |
|---|---|---|---|---|---|
| 1,692,012 | A | | 11/1928 | Wells | 116/216 |
| 3,233,459 | A | | 2/1966 | Gleason et al. | 374/106 |
| 3,515,091 | A | | 6/1970 | Smith | 116/203 |
| 3,765,025 | A | | 10/1973 | Zietzke et al. | 346/7 |
| 3,965,741 | A | | 6/1976 | Wachtell et al. | 374/102 |
| 4,143,617 | A | | 3/1979 | Youngren | 374/102 |
| 4,156,891 | A | * | 5/1979 | Roche | 362/20 |
| 4,183,536 | A | | 1/1980 | Platt | 473/570 |
| 4,362,121 | A | | 12/1982 | Pegram | 116/34 R |
| 4,789,922 | A | * | 12/1988 | Cheshire | 362/158 |
| 5,027,740 | A | | 7/1991 | Kramer et al. | 116/34 R |
| 5,144,112 | A | | 9/1992 | Wyatt et al. | 219/386 |
| 5,821,695 | A | * | 10/1998 | Vilanilam et al. | 315/58 |
| 5,918,262 | A | | 6/1999 | Sanford | 73/35.14 |
| 6,531,960 | B1 | | 3/2003 | Gladstone et al. | 340/442 |
| 6,609,865 | B2 | | 8/2003 | Daigneault | 411/13 |
| 6,639,190 | B2 | | 10/2003 | Lerner | 219/445.1 |
| 6,700,100 | B2 | | 3/2004 | Lerner | 219/445.1 |
| 6,848,389 | B1 | | 2/2005 | Elsasser et al. | 116/203 |
| 6,911,903 | B2 | | 6/2005 | Gladstone et al. | 340/442 |
| 7,013,833 | B2 | | 3/2006 | Lemberger et al. | 116/34 R |
| 7,030,743 | B2 | | 4/2006 | Morris | 340/442 |
| 7,112,766 | B2 | | 9/2006 | Lerner | 219/445.1 |
| 7,528,737 | B2 | | 5/2009 | Hedtke | 340/870.01 |
| 7,641,358 | B1 | * | 1/2010 | Smith et al. | 362/183 |
| 2004/0146084 | A1 | | 7/2004 | Hachtel et al. | 374/106 |
| 2005/0217558 | A1 | | 10/2005 | Fitzer et al. | 116/203 |
| 2006/0220895 | A1 | * | 10/2006 | Arcaria et al. | 340/815.4 |
| 2007/0241916 | A1 | | 10/2007 | Hedtke | 340/584 |
| 2009/0284381 | A1 | | 11/2009 | Manahan | 340/590 |
| 2010/0039256 | A1 | | 2/2010 | Manahan | 340/540 |
| 2010/0043695 | A1 | | 2/2010 | Reichert | 116/207 |

* cited by examiner

*Primary Examiner*—Toan N Pham
(74) *Attorney, Agent, or Firm*—King & Spalding LLP

(57) ABSTRACT

Indicator devices and systems for explosion proof enclosures are described. The indicator devices include a sleeve, a dome-like transparent member, a connector body, a first and second contact, a means for preventing the first contact from contacting the second contact, and an indicator. Upon an increase in a temperature or a pressure near the means for preventing (for example, within the enclosure), the means for preventing allows the first and second contacts to contact, thereby completing an electrical circuit from a power source to the indicator (such as a light or an alarm). The indicator systems include an indicator device coupled to an explosion proof enclosure containing critical equipment.

24 Claims, 3 Drawing Sheets

EXPLOSION INDICATOR FOR EXPLOSION-PROOF ENCLOSURES

RELATED APPLICATIONS

The present application is related to U.S. Utility patent application Ser. No. 11/960,904 entitled "Explosion Indicators for Use in Explosion-Proof Enclosures with Critical Equipment" and filed on Dec. 20, 2007, in the name of Joseph Michael Manahan, the entire disclosure of which is hereby fully incorporated herein by reference.

TECHNICAL FIELD

The invention relates to indicator devices. More particularly, the invention relates to explosion indicator devices for use with explosion-proof enclosures containing critical equipment.

BACKGROUND

The present application relates to indicator devices for use with explosion-proof enclosures containing critical equipment. Under some circumstances, enclosed equipment may be damaged when subjected to internal explosions, thus rendering the equipment faulty. Currently, devices or methods do not exist for alerting a user that an internal explosion has occurred in equipment already equipped to withstand high pressures. As a result, in some instances, the equipment may continue to operate without maintenance under unsafe or faulty conditions, which may lead to further damage to the internal equipment, as well as damage to any downstream equipment connected to the internal equipment.

Accordingly, a need exists in the art for providing an indication of an internal explosion within an explosion proof enclosure.

SUMMARY

The invention satisfies the above-described need by providing an indicator device having a sleeve, a dome-like transparent member, a connector body, a first and second contact, means for preventing the first contact from contacting the second contact, and an indicator. The sleeve is open at each end and includes a bore therein. The connector body couples the sleeve at a first end to the transparent member, and may be a cylindrical unit or a guard unit. The indicator devices also may include a gasket positioned between the sleeve and the transparent member. In some embodiments, the transparent member may be a glass jewel. The first and second contacts are coupled to a second end of the sleeve and are separated from each other by the means for preventing the first contact from contacting the second contact. Generally, the means for preventing the first contact from contacting the second contact responds to a temperature differential and/or pressure differential. In some instances, the means for preventing the first contact from contacting the second contact may be a fuse or a latch. The indicator is in communication with at least one of the first and second contacts. In some embodiments, the indicator is a light source, such as a LED light, and may be disposed within a chamber created by the cavity of the transparent member being in communication with the sleeve bore. In some embodiments, the light source may be sealed within the bore of the sleeve. In alternative embodiments, the indicator may be an audible alarm in communication with an external facility.

Explosion indicator systems are also provided, wherein an indicator device of the invention is coupled to an enclosure containing critical equipment.

The features of the invention will be readily apparent to those having ordinary skill in the art upon a reading of the description of the exemplary embodiments that follows.

BRIEF DESCRIPTION OF THE DRAWINGS

The invention may be better understood by reading the following description of non-limiting, exemplary embodiments with reference to the attached drawings, wherein like parts of each of the figures are identified by the same reference characters, and which are briefly described as follows.

The drawings illustrate only exemplary embodiments of the invention and are therefore not to be considered limiting of its scope, as the invention may admit to other equally effective embodiments.

DETAILED DESCRIPTION OF EXEMPLARY EMBODIMENTS

The present application relates to indicator devices. More particularly, the present application relates to explosion indicator devices for use with explosion-proof enclosures containing critical equipment. The indicator devices of the invention are of simple construction and assembled from easily replaceable parts, therefore possibly minimizing costs of servicing damaged or used devices.

Figure 1A:
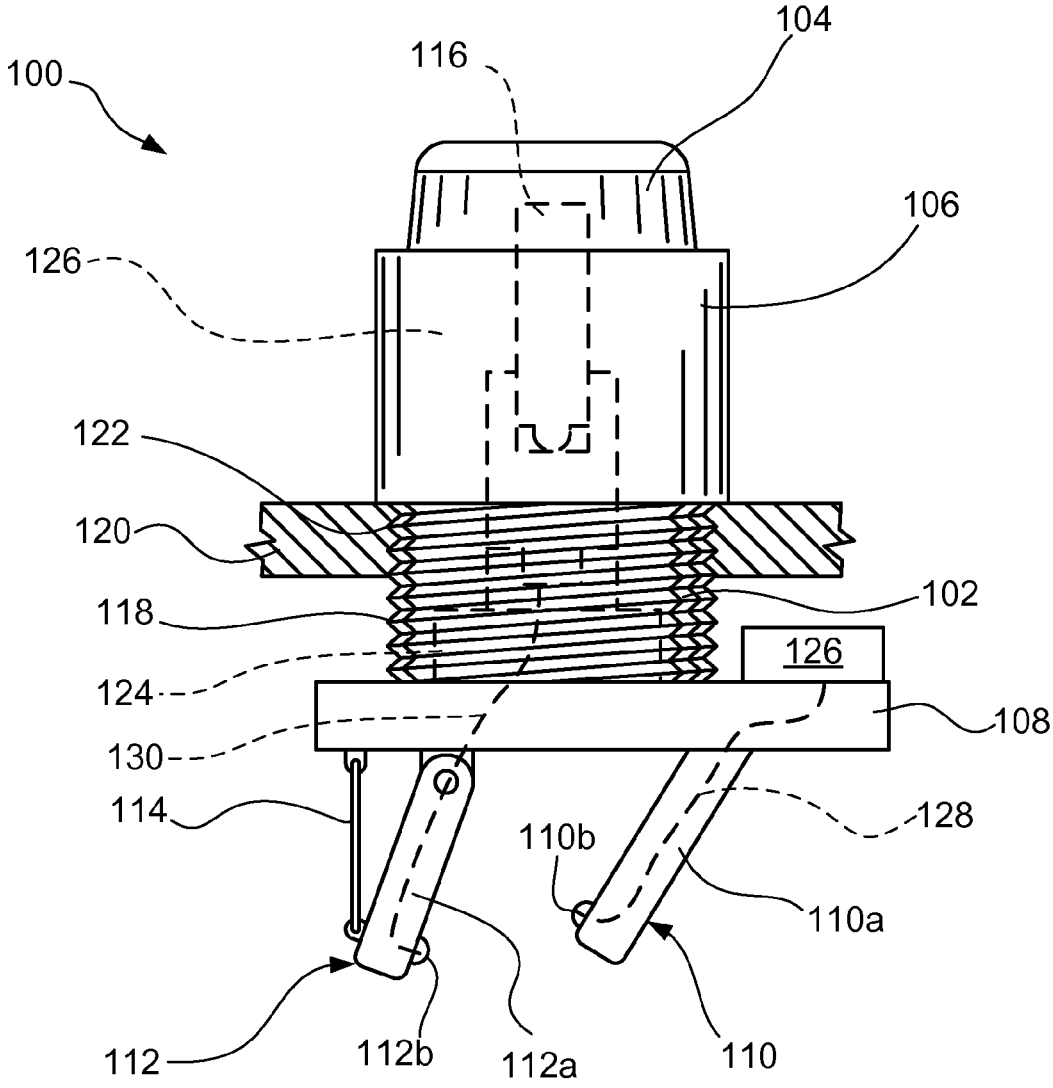
FIG. 1A is a side view of an explosion indicator device according to an exemplary embodiment of the invention.
Figure 1B:
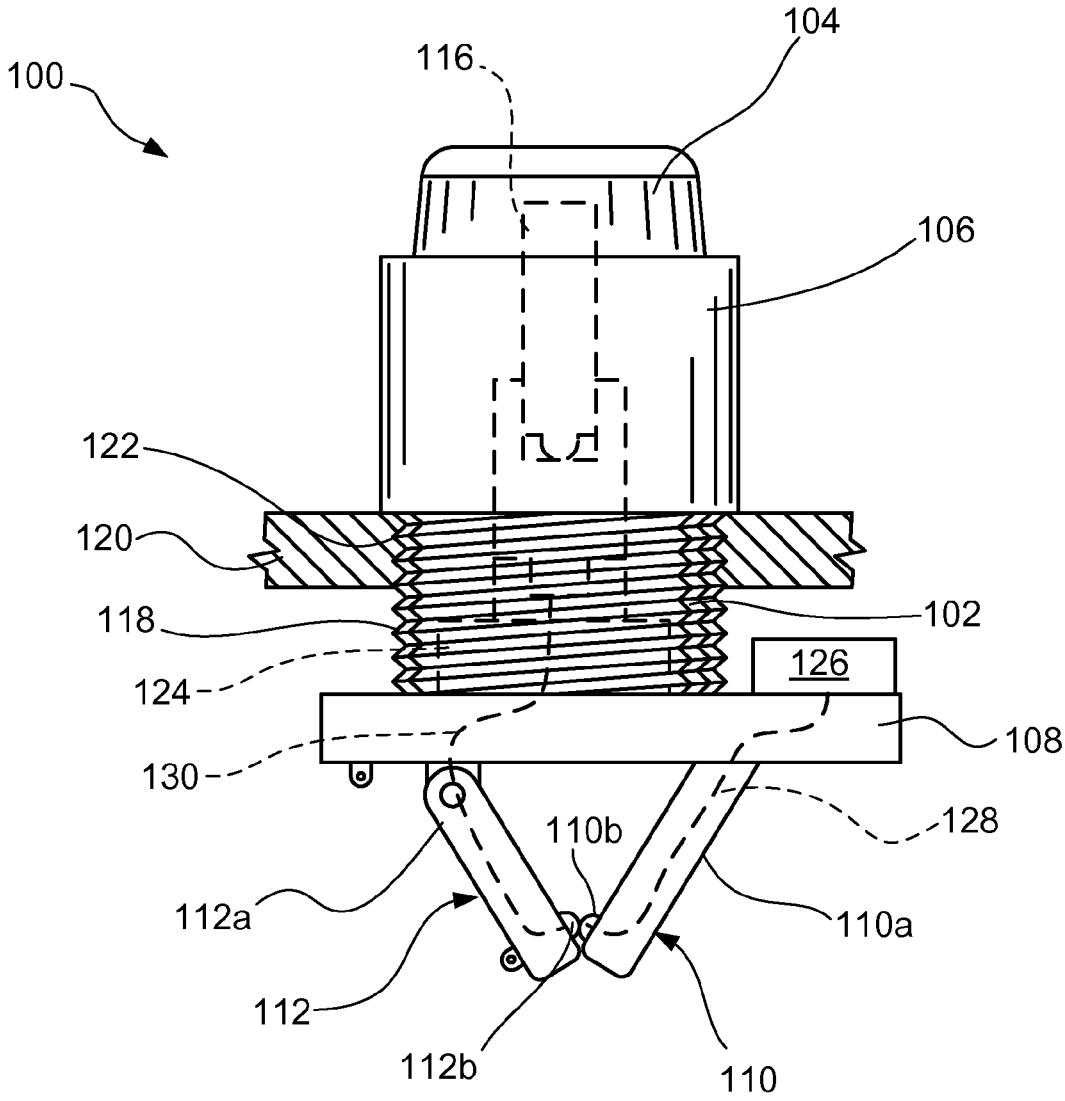
FIG. 1B is a side view of the explosion indicator device of FIG. 1A after being activated.
Figure 1C:
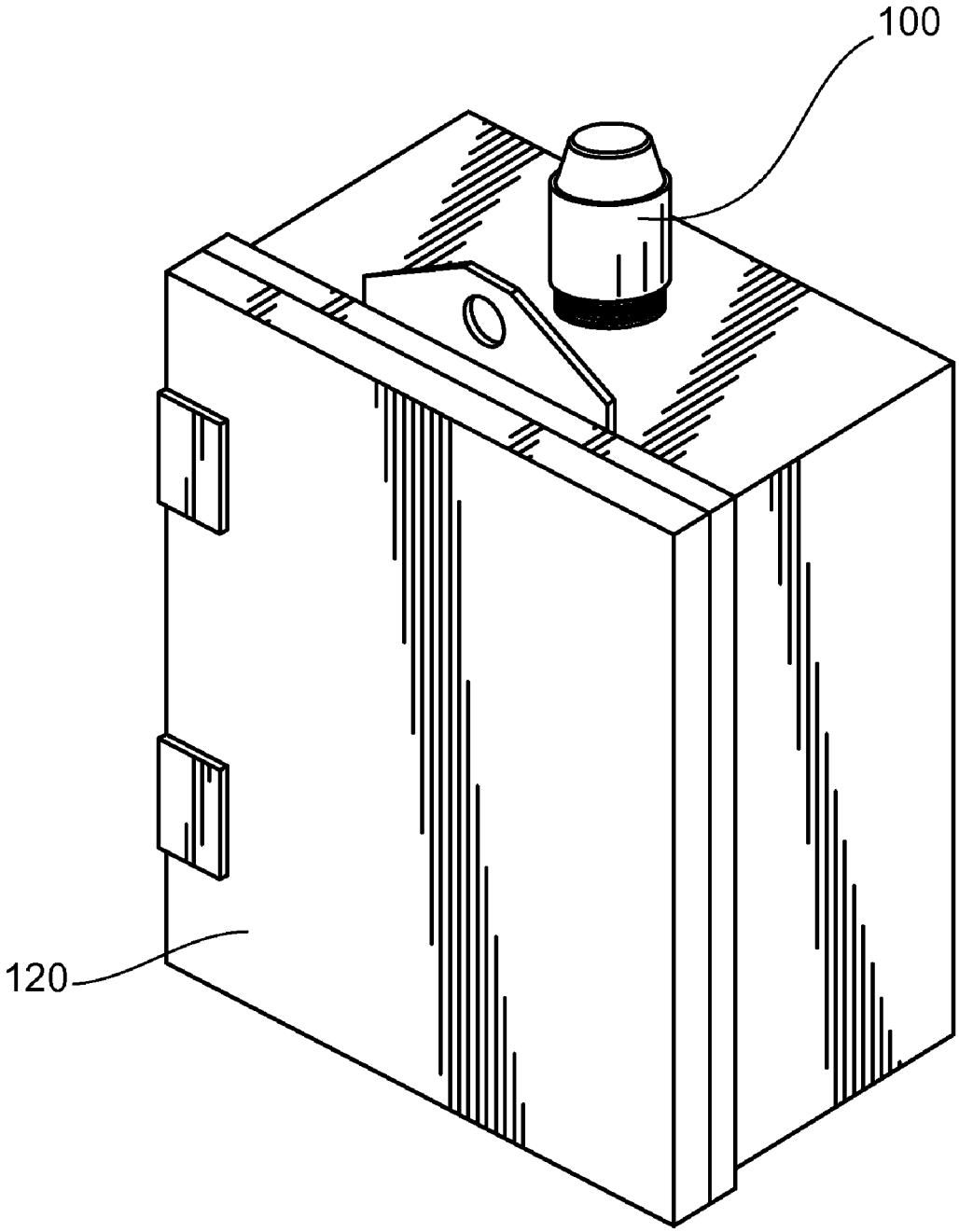
FIG. 1C is a perspective view of the explosion indicator device of FIG. 1A mounted to an explosion-proof enclosure containing critical equipment according to an exemplary embodiment of the invention.

Referring to FIGS. 1A-1C, an exemplary embodiment of an indicator device 100 includes a sleeve 102, a glass jewel 104 having a cavity (not shown), a connector body 106, a plate 108, a stationary contact 110, a movable contact 112, a fuse element 114, and an indicator 116 such as an LED or an audible alarm. Sleeve 102 is open at each end and includes a bore (not shown) therein. The glass jewel cavity and the bore are in communication so as to create a chamber within which the indicator is positioned. Sleeve 102 includes exterior threads 118 which threadably engage with connector body 106 having interior threads (not shown) and enclosure 120 having interior threads 122. In certain embodiments, the sleeve 102 is threadably connected to the plate 108. In alternative embodiments, the sleeve 102 is welded to the plate 108.

The stationary contact 110 includes an arm 110*a* and a contact point 110*b* disposed on the arm 110*a*. In certain embodiments, the arm 110*a* of the stationary contact 110 is fixed to the plate 108. In certain embodiments, the arm 110*a* of the stationary contact 110 is angled towards the movable contact 112.

The movable contact 112 includes an arm 112*a* and a contact point 112*b* disposed on the arm 112*a*. The arm 112*a* of the movable contact 112 may be hingedly or pivotally connected to the plate 108. The arm 112*a* of the movable contact 112 is biased towards the stationary contact point 110*b*. In certain embodiments, a spring (not shown) exerts force on the arm 112*a* of the movable contact 112 towards the stationary contact point 110*b*, and the fuse element 114 counteracts that force until an explosion occurs.

Fuse element 114 is coupled to the plate 108 and the arm 112*a* of the movable contact 112. Fuse element 114 may be coupled to the plate 108 and the movable contact 112 by any means known to one having ordinary skill in the art. In certain embodiments, the fuse 114 is disposed within the explosion-proof enclosure 120. The fuse element 114 prevents the movable contact 112 from contacting the stationary contact 110.

The stationary contact point 110*b* is electrically coupled to a power source 126 via conductor 128. In certain embodiments, the power source 126 is positioned adjacent to the plate 108 and exterior to the indicator sleeve 102. In alternative embodiments, the power source 126 is positioned within the indicator sleeve 102 (not shown).

In certain exemplary embodiments, the indicator 116 is a light source. The indicator 116 may be sealed within the bore of the sleeve 102 with a sealing material 124. The indicator 116 is electrically coupled to the movable contact point 112*b* via conductor 130. When the temperature is such that the fuse element 114 melts, the movable contact point 112*b* contacts the stationary contact point 110*b* and completes a circuit as indicated by FIG. 1B, and the indicator device 100 is then activated and the power source 126 is electrically coupled to the indicator 116.

Generally, the indicator device 100 of the invention includes sleeve 102 open at a first end and a second end and having a bore therein, a dome-like transparent member such as glass jewel 104 having a cavity, connector body 106, a first contact such as movable contact 112, a second contact such as stationary contact 110, means for preventing the first contact from contacting the second contact such as fuse element 114 or an actuator element, and an indicator 116. The transparent member is coupled to the first end of the sleeve 102 by the connector body 106 such that the cavity of the transparent member is in communication with the bore of the sleeve 102 to thereby create a chamber, and the indicator is positioned within the chamber. The first contact and the second contact are coupled to the second end of the sleeve 102, and the indicator 116 is operably connected to the first contact, the second contact, or both. In some embodiments, the indicator device 100 may further include a gasket, seal, or other sealing device positioned between the sleeve 102 and the transparent member. In some embodiments, the indicator device 100 may include a sealing material 124 for sealing the indicator 116 within the bore of the sleeve 102. The materials of construction for the indicator device 100 of the invention depend on a variety of factors, such as the operating temperature and pressure, the particular application, equipment conditions, and the like, which will be recognizable by a person having ordinary skill in the art.

The sleeve 102 of the indicator device 100 of the invention may be made of any material that can withstand the presence of flammable vapors, gases, or highly combustible dusts. Suitable examples of sleeve 102 materials include, but are not limited to, brass, stainless steel, aluminum, or plastics appropriate for hazardous applications. The sleeve 102 construction should provide integrity to the indicator device 100. For example, threads 118 may be included in the sleeve 102 to provide a flame-resistant exit path in the case of an explosion.

Suitable examples of the dome-like transparent member include, but are not limited to, glass jewel 104, transparent plastic materials, or other means of visualizing an indicator. In some embodiments, the dome-like transparent member may be clear. In some embodiments, the dome-like transparent member may be colored so as to enhance visually any light emitted by the indicator within.

The connector body 106 of the indicator device 100 of the invention may be made of any material that can withstand the presence of flammable vapors, gases, or highly combustible dusts. Suitable examples of connector body 106 materials include, but are not limited to, those suitable for environmental exposure. The connector body 106 is a mechanical means to connect the transparent member to the sleeve 102. The connector body 106 also may provide an explosion proof joint between the transparent member and the connector body 106 via a flat flamepath, and/or an explosion proof joint within the body via a threaded flamepath. Furthermore, the connector body 106 may be a guard unit for protecting the dome-like transparent member to achieve higher impact standards.

The sleeve 102 of the invention is coupled to a first contact and a second contact at the end opposite the end of the sleeve 102 that is coupled to the transparent member. In some embodiments, the first contact and the second contact can be directly coupled to the sleeve 102 end. In other embodiments, the first contact and the second contact can be coupled to a separate piece, such as a plate 108, that may be coupled to or around the sleeve 102 end. In some embodiments, the first contact may be movable contact 112 and the second contact may be stationary contact 110. In this instance, the movable first contact 112 is coupled to a means for preventing the first contact from contacting the second contact so as to prevent the movable first contact 112 from contacting the stationary second contact 110. In other embodiments, the first and second contacts are both movable. In this instance, both movable contacts are coupled to a means for preventing the first contact from contacting the second contact so as to prevent the first contact from contacting the second contact.

In certain embodiments, the plate 108 is fabricated from an insulating material. In certain embodiments, the arm 110*a* of the stationary contact 110 is fabricated from an insulating material. In certain embodiments, the arm 112*a* of the movable contact 112 is fabricated from an insulating material. Suitable examples of insulating materials include, but are not limited to, glass-reinforced nylon and glass-reinforced polyester.

Suitable examples of means for preventing the first contact from contacting the second contact include, but are not limited to, a burnable or pressure-sensitive fuse element 114 or a latch, or an actuator element. In some embodiments, if the temperature-sensitive fuse 114 or latch is exposed to an explosion in the enclosure 120, the movable first contact 112 trips and contacts the stationary second contact 110. In certain embodiments, the actuator element is a temperature sensitive device or a pressure sensitive device that disintegrates upon an increase in temperature or pressure above a threshold.

The first contact and second contact are electrically connected to a power source 126. When the first contact and the second contact come in contact with each other, a circuit is completed from the power source 126 through the contacts to the indicator, thereby energizing the indicator 116. The second contact may be energized by a battery or other suitable power source. In certain embodiments, conductors 128, 130 may connect the indicator 116 to the first and second contacts by running through the bore of the sleeve 102. In some embodiments, the indicator 116 may be a light source, such as a light-emitting diode (LED), positioned in the chamber of the indicator device 100 and sealed therein with a sealing material 124. Suitable examples of sealing material 124 include, but are not limited to, epoxy fillers and Chico™ sealing compound commercially available from Cooper Industries, Inc.

In some embodiments, the indicator 116 may be an audible alarm or other suitable alarm positioned in the chamber of the indicator device 100, which communicates an audible or visual alarm signal and/or a text message displayed locally or communicated to a monitoring station. In some embodiments, the indicator may be an alarm (not shown) external to the indicator device 100 and wired into a facilities emergency system or a fire alarm.

Generally, systems of the invention comprise the indicator device 100 of the invention coupled to enclosure 120. The indicator device 100 of the invention may have features that allow it to be easily coupled to enclosure 120 comprising equipment. For example, the sleeve 102 may include outer threads 118 adapted for threading engagement with complimentary threads 122 formed in the interior of the enclosure 120 wall. In another example, the indicator device 100 may include a highly machined flat surface (not shown) that may be bolted or secured to a highly machined flat surface of the enclosure 120. Alternatively, the threaded sleeve 102 of the indicator device 100 may be coupled to the enclosure 120 via a nut (not shown) or threads on the plate located within the enclosure 120.

Generally, methods of providing a system for detecting a high stress event, comprise providing the indicator device 100 of the invention coupled to the explosion proof enclosure 120, wherein upon exposure to a temperature differential, pressure differential, or both, the means for preventing the first contact from contacting the second contact responds to allow the first contact to contact the second contact to activate the indicator 116.

Therefore, the invention is well adapted to attain the ends and advantages mentioned as well as those that are inherent therein. The particular embodiments disclosed above are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed herein may be altered or modified and all such variations are considered within the scope and spirit of the claimed invention. The terms in the claims have their plain, ordinary meaning unless otherwise explicitly and clearly defined by the patentee.

What is claimed is:

1. An indicator device, comprising:

a sleeve having a hole formed therein;

a transparent member coupled to a first end of the sleeve; and a first contact and a second contact coupled to a second end of the sleeve;

means for preventing the first contact from contacting the second contact; and an indicator in communication with at least one of the first contact and the second contact, wherein the means is actuated in response to a temperature differential, pressure differential, or both, and wherein when the means is actuated, the first contact contacts the second contact.

2. The indicator device of claim 1, wherein the transparent member is coupled to the first end of the sleeve by a connector body.

3. The indicator device of claim 1, wherein the means is fixed at one end to the sleeve and at another end to the second contact.

4. The indicator device of claim 1, wherein the first contact is stationary and the second contact is movable toward and away from the first contact.

5. The indicator device of claim 1, further comprising a plate coupled to the second end of the sleeve, the first contact and the second contact being coupled to the sleeve by being coupled to the plate.

6. The indicator device of claim 5, wherein the means is fixed at one end to the plate and at another end to the second contact.

7. The indicator device of claim 5, wherein the second contact is pivotally mounted to the plate.

8. The indicator device of claim 1, wherein the means for preventing the first contact from contacting the second contact comprises at least one of a fuse element or a latch.

9. The indicator device of claim 1, wherein the means is temperature-sensitive or pressure-sensitive.

10. The indicator device of claim 1, wherein the transparent member comprises a cavity that is in communication with the hole to thereby create a chamber, and wherein the indicator is a light source disposed within the chamber.

11. The indicator device of claim 1, wherein the indicator comprises an alarm in communication with an external facility.

12. An indicator system, comprising:

an enclosure; and an indicator device coupled to the enclosure, wherein the indicator device comprises:

a sleeve having a hole formed therein;

a transparent member coupled to a first end of the sleeve; and a first contact and a second contact coupled to a second end of the sleeve;

an actuator element preventing the first contact from contacting the second contact; and an indicator in communication with at least one of the first contact and the second contact, wherein the actuator element is actuated in response to a temperature differential, pressure differential, or both, and wherein when the actuator element is actuated, the first contact contacts the second contact.

13. The indicator system of claim 12, wherein the transparent member is coupled to the first end of the sleeve by a connector body.

14. The indicator system of claim 12, wherein the actuator element is fixed at one end to the sleeve and at another end to the second contact.

15. The indicator system of claim 12, wherein the first contact is stationary and the second contact is movable toward and away from the first contact.

16. The indicator system of claim 12, further comprising a plate coupled to the second end of the sleeve, the first contact and the second contact being coupled to the sleeve by being coupled to the plate.

17. The indicator system of claim 16, wherein the actuator element is fixed at one end to the plate and at another end to the second contact.

18. The indicator system of claim 16, wherein the second contact is pivotally mounted to the plate.

19. The indicator system of claim 12, wherein the actuator element is a temperature sensitive device or a pressure sensitive device that disintegrates upon an increase in temperature or pressure above a threshold.

20. The indicator system of claim 12, wherein the actuator element is disposed within the enclosure.

21. The indicator system of claim 12, wherein the transparent member comprises a cavity that is in communication with the hole to thereby create a chamber, and wherein the indicator is a light source disposed within the chamber.

22. The indicator system of claim 12, wherein the indicator comprises an alarm in communication with an external facility.

23. The indicator system of claim 12, wherein the enclosure is explosion-proof.

24. An indicator system, comprising:

an explosion-proof enclosure; and an indicator device coupled to the explosion-proof enclosure, wherein the indicator device comprises:

a sleeve having a hole formed therein;

a transparent member coupled to a first end of the sleeve by a connector body; and a movable contact and a stationary contact coupled to a second end of the sleeve;

a fuse element coupled to the movable contact and the second end of the sleeve, the fuse element preventing the movable contact from contacting the stationary contact, the fuse element disintegrating upon an increase in temperature above a threshold; and an indicator in communication with at least one of the movable contact and the stationary contact, wherein the indicator is a light source.

* * * * *